US007099572B2

(12) United States Patent
Phillips

(10) Patent No.: US 7,099,572 B2
(45) Date of Patent: Aug. 29, 2006

(54) WATER HEATING SYSTEM AND METHOD FOR DETECTING A DRY FIRE CONDITION FOR A HEATING ELEMENT

(75) Inventor: Terry G. Phillips, Meridianville, AL (US)

(73) Assignee: Synapse, Inc., Huntsville, AL (US)

( * ) Notice: Subject to any disclaimer, the term of this patent is extended or adjusted under 35 U.S.C. 154(b) by 0 days.

(21) Appl. No.: 11/117,069

(22) Filed: Apr. 28, 2005

(65) Prior Publication Data

US 2006/0013573 A1 Jan. 19, 2006

Related U.S. Application Data

(60) Provisional application No. 60/584,401, filed on Jun. 30, 2004.

(51) Int. Cl.
*F24H 1/18* (2006.01)

(52) U.S. Cl. ..... 392/459; 392/449; 392/498

(58) Field of Classification Search ..... None
See application file for complete search history.

(56) References Cited

U.S. PATENT DOCUMENTS 5,197,475 A 3/1993 Antich et al.
6,015,383 A 1/2000 Buhler et al.
6,137,955 A * 10/2000 Krell et al. ..... 392/454
6,265,699 B1 7/2001 Scott
6,308,009 B1 10/2001 Shellenberger et al.
6,350,967 B1 * 2/2002 Scott ..... 219/497
6,455,820 B1 9/2002 Bradenbaugh
6,649,881 B1 11/2003 Scott et al.
6,795,644 B1 * 9/2004 Bradenbaugh ..... 392/463

FOREIGN PATENT DOCUMENTS

WO WO 00/24307 5/2000
WO WO 00/62676 10/2000

OTHER PUBLICATIONS

Tavakoli, M.B. and Evans, J.A., "Dependence of the velocity and attenuation of ultrasound in bone on the mineral content," *Phys. Med. Biol.*, vol. 36, No. 11, 1991, pp. 1529-1537.
Laugier, P., et al., "Quantitative Ultrasound for Bone Status Assessment," *2000 IEEE Ultrasonics Symposium*, pp. 1341-1350.

* cited by examiner

*Primary Examiner*—Thor S. Campbell
(74) *Attorney, Agent, or Firm*—Thomas, Kayden, Horstemeyer & Risley, L.L.P.

(57) ABSTRACT

A water heating system has a tank, a heating element, a temperature sensor, and a controller. The heating element is mounted on the tank, and the temperature sensor is mounted on the heating element. The controller is coupled to the temperature sensor and is configured to detect a dry fire condition associated with the heating element based on the temperature sensor.

21 Claims, 3 Drawing Sheets

WATER HEATING SYSTEM AND METHOD FOR DETECTING A DRY FIRE CONDITION FOR A HEATING ELEMENT

CROSS REFERENCE TO RELATED APPLICATION

This application is related to U.S. Application Ser. No. 60/584,401 entitled "Apparatus and Method for Fluid Temperature Control" filed on Jun. 30, 2004, which is incorporated herein by reference.

FIELD OF THE DISCLOSURE

The present invention generally relates to electrical hot water heaters. More particularly, the disclosure relates to an apparatus and method for detecting overheating conditions of electrical heating elements when the elements are not submerged in water.

TECHNICAL BACKGROUND

Devices such as hot water heaters, furnaces, and other appliances commonly include one or more heating elements that are controlled by a controller such as a thermostat. The heating element is placed in an on-state when heat is needed and turned to an off-state when heat is not required. The change of states normally occurs when a control signal turns a power relay on or off. Power relays have a pair of contacts capable of meeting the current requirements of the heating element. In a typical home-use hot water heater, approximately 220 volts AC is placed across the heating element and a current of about 10 to 20 amperes flows. If the heating element fails, then the water heater may be unable to heat water to a desired temperature until the failed element is repaired or replaced.

A heating element is typically associated with an upper temperature threshold, referred to as the "upper set point," and a lower temperature threshold, referred to as the "lower set point," that are used for control of the heating element. When the temperature of water in a tank exceeds the upper set point, as measured by a thermal sensor mounted on a wall of the water heater, the heating element is transitioned to the off-state. If the water temperature drops below the lower set point the heating element is placed in the on-state. As heated water is repeatedly withdrawn from the water tank and replenished with cold water, the heating element goes through on/off cycles.

One problem associated with water heaters having electrical heating elements is the destruction of the elements caused by a dry fire condition. A dry fire condition exists when a heating element of a water heater is not submerged in water. Such a condition may exist due to improper installation or operation of the water heater. If power is applied to a heating element when the element is not covered with water, then the heating element can quickly heat to an extremely high temperature resulting in damage to the heating element and/or other components of the water heater. Hence, there is a need for preventing damage resulting from operation of a heating element during a dry fire condition.

SUMMARY OF DISCLOSURE

Generally, the present disclosure pertains to water heating system capable of automatically detecting dry fire conditions.

A water heating system in accordance with one exemplary embodiment of the present disclosure comprises a tank, a heating element, a temperature sensor, and a controller. The heating element is mounted on the tank, and the temperature sensor is mounted on the heating element. The controller is coupled to the temperature sensor and is configured to detect a dry fire condition associated with the heating element based on the temperature sensor.

A method in accordance with one exemplary embodiment of the present disclosure detects a dry fire condition in a water heating system having a heating element. The method comprises the steps of: sensing first and second temperatures of the heating element at different times based on a temperature sensor coupled to the heating element; and detecting a dry fire condition based on the first and second temperatures.

BRIEF DESCRIPTION OF THE DRAWINGS

The invention can be better understood with reference to the following drawings. The elements of the drawings are not necessarily to scale relative to each other, emphasis instead being placed upon clearly illustrating the principles of the invention. Furthermore, like reference numerals designate corresponding parts throughout the several views.

DETAILED DESCRIPTION

Figure 1:
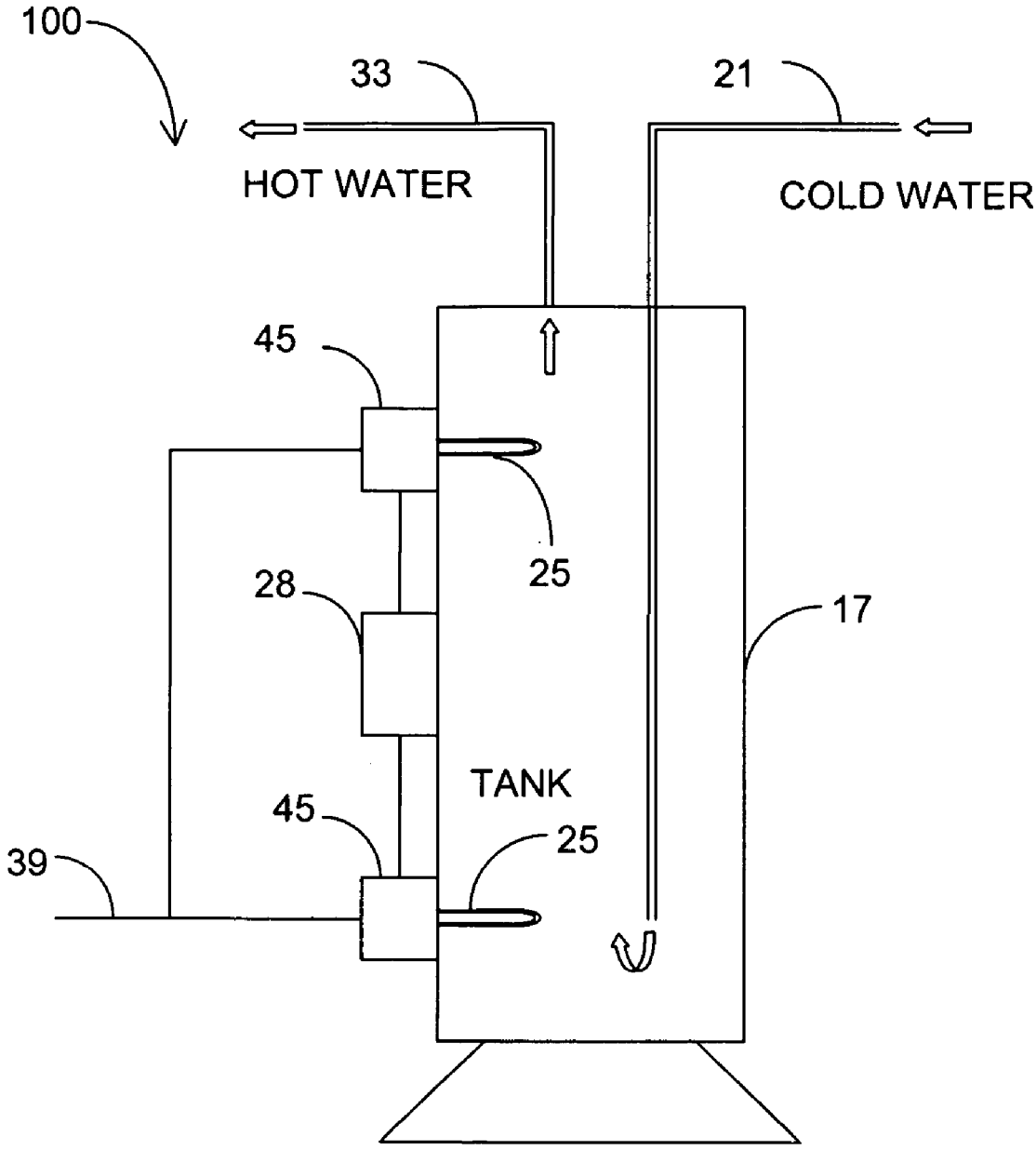
FIG. 1 illustrate an exemplary embodiment of a water heating system.

Reference will now be made in detail to embodiments of the disclosure, examples of which are illustrated in the accompanying figures. Wherever possible, the same reference numerals will be used throughout the drawing figures to refer to the same or like parts.

Generally, and as depicted in FIG. 1, a water heating system 100 has a controller 28 and at least one relay 45 for applying electrical power to at least one heating element 25 located within a water tank 17. Note that FIG. 1 depicts two heating elements 25, an upper heating element (close to the top of the tank 17) and a lower heating element (close to the bottom of the tank 17). Other numbers and locations of heating elements may be used in other embodiments.

Activation/deactivation of each heating element 25 is controlled, in part, by a respective relay 45. FIG. 1 depicts two such relays, one for controlling the upper heating element 25 and the other for controlling the lower heating element 25. The relays 45 receive power from an AC power source (not shown) using power wire pair 39, where the voltage across the wire pair in one embodiment is generally around 220 V AC.

Each respective relay 45 is controlled by a control signal, generally a low voltage, provided by the controller 28. The relay 45 has a coil, sometimes called a winding, that provides a magnetic force for closing contacts of the relay. When a control current from the controller 28 flows in the coil of the relay, the contacts of the relay are in a closed position and current flows to the heating element 25. Generally, each of the relays 45 of FIG. 1 is independently turned off or on so as to independently provide current to each of the heating elements 25. The switching function of the relay may be provided in other embodiments by solid-state relays, SCRs, and other relay devices known to those skilled in the art.

The controller 28 preferably can have a user interface capable of providing information about the water heating system 100 and in addition enabling a user to provide commands or information to the controller 28. An exemplary controller 28 is described in U.S. patent application Ser. No. 10/772,032, entitled "System and Method for Controlling Temperature of a Liquid Residing within a Tank," which is incorporated herein by reference. The controller 28 can process both user and sensor input using a control strategy for generating control signals, which independently control the relays 45 and hence the on-state and off-state of the heating element 25. The controller 28 may be implemented in hardware, software, or a combination thereof.

Figure 2:
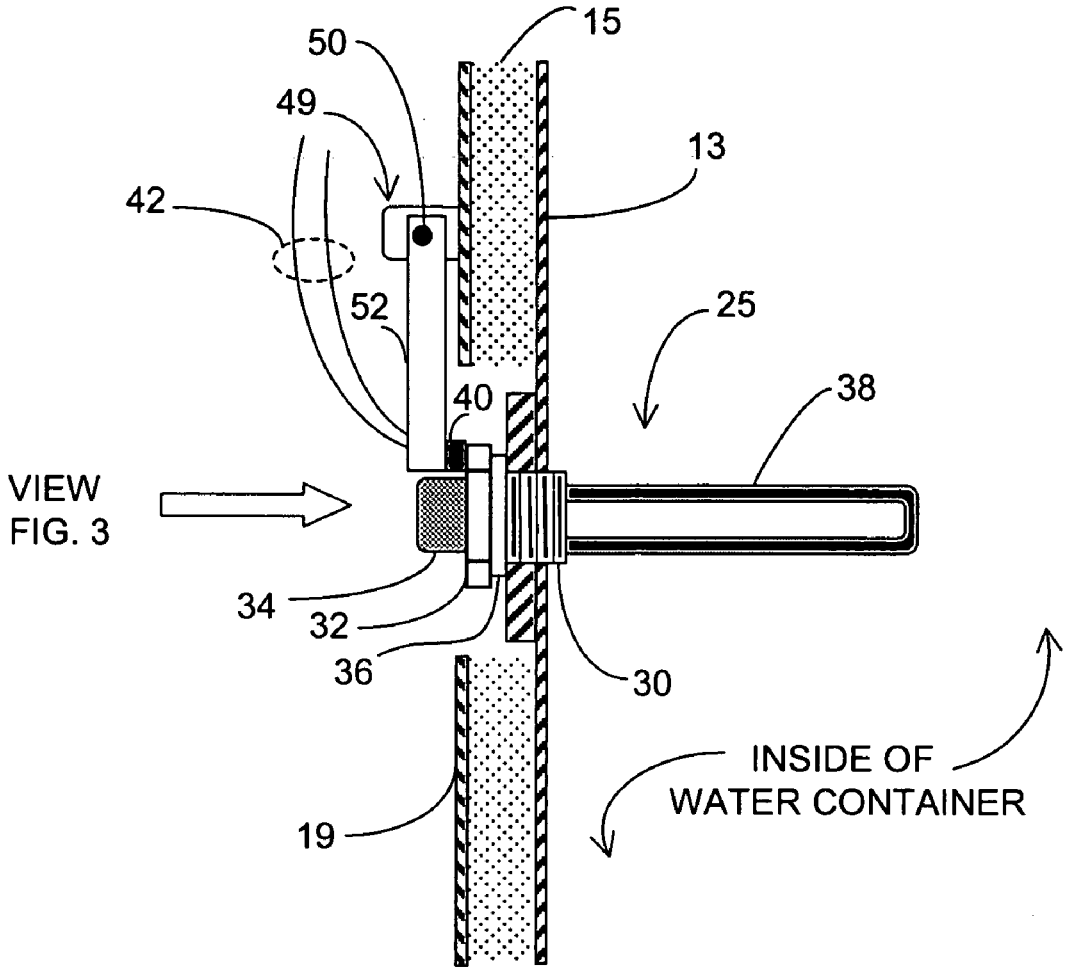
FIG. 2 illustrates a heating element mounted on a water tank of the water heating system depicted in FIG. 1.

FIG. 2 illustrates an exemplary heating element 25 utilized to heat water contained in the tank 17 of the water heating system 100 of FIG. 1. The tank 17 is comprised of a cylindrical container having a container wall 13 for holding water, a cylindrical shell 19 that surrounds the cylindrical container and insulation 15 therebetween. The heating element 25 extends through a hole passing through the wall 13, insulation 15, and shell 19. Other shapes and configurations of the tank 17 are possible in other embodiments.

A connector end of the heating element 25 has terminals (not shown) on a connector block 34 for coupling power from the power wires 39 (FIG. 1) to the terminals of the heating element 25 through the relay 45 (FIG. 1). For simplicity, the relay 45 for controlling operation of the heating element 25 is not shown in FIG. 2.

Figure 3:
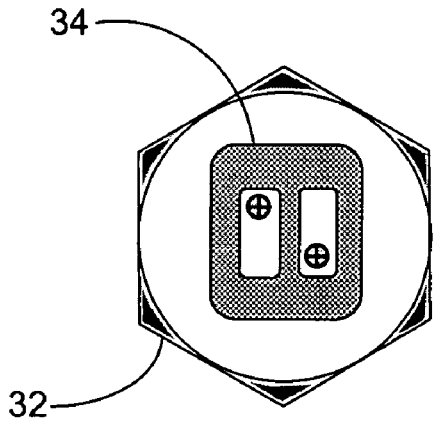
FIG. 3 illustrates a different perspective view of the heating element depicted in FIG. 2.

The heating element 25 has a heater rod 38, having electrical resistance, that converts electrical energy into heat. The heating element 25 further has a hexagonal shaped head 32, next to the connector block 34. Both the hexagonal-shaped head 32 and the connector block 34 are exposed when the heating element 25 is mounted on the tank 17 as shown by FIG. 2. FIG. 3 depicts another perspective of the connector block 34 and hexagonal-shaped head 32. In FIGS. 2 and 3, the hexagonal-shaped head 32 is a plate through which the connector block 34 passes. However, the head 32 may have shapes different than that depicted in FIGS. 2 and 3.

A wrench may be placed on the hexagonal-shaped head 32 to turn the heating element 25. When the heating element 25 is rotated in the appropriate direction, the threads 30 on the heating element 25 are screwed into the container wall 13 thereby securing the heating element to the tank 17. The heating element 25 is preferably sufficiently screwed into the wall 13 such that a seal 36 is pressed between the head 32 and the wall 13 to prevent water from within the container from escaping via the hole through which the heating element 25 passes. The heater rod 38 of the heating element 25 is a U-shaped rod comprised of resistive heating material that is covered with a metallic skin. Different configurations of the heating element 25 are possible, but the heating element 25 as shown in FIG. 2 is available at most plumbing supply or hardware stores.

When the water tank 17 of a water heating system 100 is initially installed, the tank may not contain water, i.e., the tank may be empty. Thus, a dry fire condition exists for the heating element 25 until the tank 17 is sufficiently filled with water so that the heating element 25 is submerged in the water. It is generally undesirable and hazardous to apply power to the heating element 25 during a dry fire condition. Indeed, if power is applied to the heating element 25 during a dry fire condition, the heat generated by the resistance of the heating element 25 is almost entirely absorbed by heating element 25 possibly causing it to melt or disintegrate which may cause damage to the water tank 17. If the dry fire condition continues, then the heating element and other components of the heating system may ignite and/or cause a fire.

As shown by FIG. 2, a temperature sensor 40 is coupled to the hexagonal-shaped head 32 of the heating element 25 and is used to detect a temperature of the heating element 25. In one embodiment, the sensor 40 is a thermistor that is coupled to the controller 28 via conductive sensor leads 42. Other types of sensors may be used in other embodiments.

FIG. 2 also shows an attachment apparatus 49 for attaching the sensor 40 to the heating element 25. The attachment apparatus 49 has a pivot pin 50 and a pivot arm 52. The pivot pin 50 is coupled to the pivot arm 52, which has the sensor 40 mounted on its other end. The pivot arm 52 is spring loaded so as to push the sensor 40 against the hexagonal-shaped head 32 of the heating element 25. Sensor leads 42 connect the sensor 40 to the controller 45, which converts sensor information to temperature values. The controller 45 also determines if there is an uncharacteristic or atypical change in the temperature detected by the sensor 40. For example, if the temperature increases rapidly (e.g., several degrees in around a second), then the controller 28 may detect a dry fire condition and, in response, initiate a safeguard procedure to protect the heating element 25 from damage. The amount of temperature change indicative of a dry-fire condition may vary with different heating elements and depend on the heat transfer characteristics of the heating element.

In one embodiment, the rate of change in temperature is an indicator of a dry-fire condition. For example, if a temperature change ($\Delta T$) occurs over a time change ($\Delta t$), then the rate of change in temperature is ($\Delta T/\Delta t$). When the rate of change in temperature exceeds a threshold value (TH), then the controller 28 detects a dry-fire condition. Other algorithms for detecting a dry fire condition based on temperatures sensed by the sensor 40 are possible in other embodiments.

Note that having the temperature sensor 40 coupled directly to the heating element 25, as described herein, enables the controller 28 to rapidly detect a dry fire condition once power is applied to the heating element 25. Thus, when power is first applied to the heating element 25 after installation or some other event, the controller 28 can quickly detect whether a dry fire condition exists. Rapid detection of the dry fire condition can be critical in preventing damage to the heating element 25 and/or other components of the heating system 100. Moreover, using the dry fire detection methodolgy described herein via a temperature sensor coupled directly to the heating element 25, it has been shown that a dry fire condition can be detected in just a few seconds for many water heating systems 100.

Further note that it is unnecessary for the sensor 40 to be coupled to the heating element 25 via the attachment apparatus 49. Indeed, it is possible for the sensor 40 to be embedded within the heating element 25.

Upon detecting a dry fire condition, the controller 28 transmits a control signal to prevent current from flowing through the relay 45 to the heating element 25. For example, when the relay 45 has a coil for controlling the open and close state of the relay 45, as described above, the control signal from the controller 28 may cause the removal of power from the coil thereby opening the relay contacts so that current no longer flows in the heating element 25. By detecting dry fire conditions and disabling the heating element 25 in response to detected dry fire conditions, as described herein, undesirable water heater damage and safety hazards may be prevented.

Figure 4:
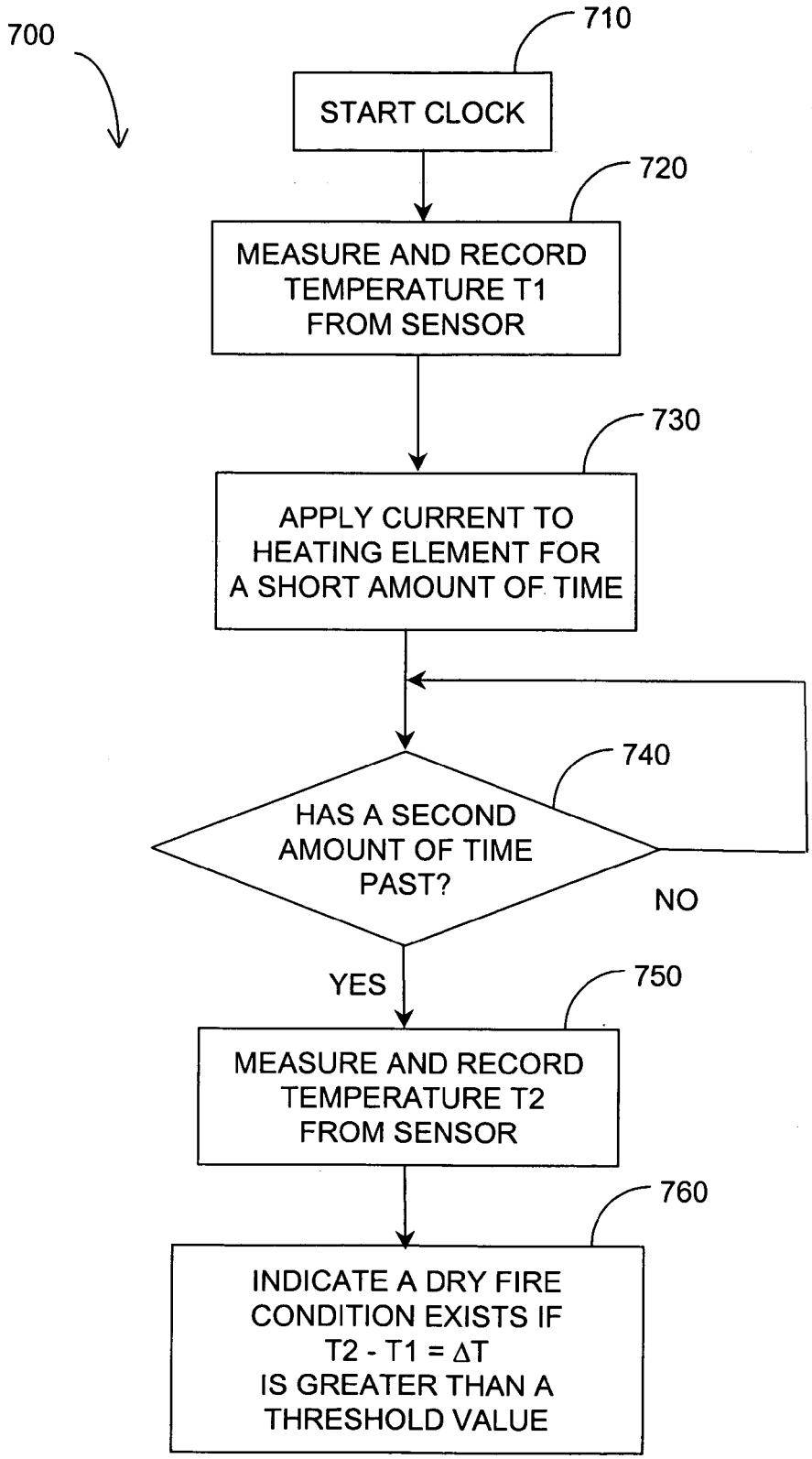
FIG. 4 depicts a flow chart illustrating an exemplary methodology for determining if a dry fire condition exists for the heating element of FIG. 2.

FIG. 4 is a flow chart showing an exemplary methodology 700 for detecting a dry fire condition for a heating element 25. The controller 28 preferably has a clock (not shown), which is started, step 710, for recording the time of events. A temperature, T1, from the sensor 40 contacting the hexagonal-shaped head 32 of the heating element 25 is measured and recorded, step 720. Current is applied for a short amount of time to the heating element 25, step 730. It is important that the short amount of time be small enough to avoid damage to the heating element 25 or other components of the water heating system 100 in case the heating element 25 is not submerged in water. Experiments have shown that damage to the heating element 25 and/or other components of the system 100 may occur if the heating element 25 is activated for just a few seconds (e.g., approximately 10–15 seconds) without being submerged in water. Thus, an activation time of approximately 5 seconds or less may be sufficient to enable the detection of a dry fire condition without significantly risking damage to any of the components of the system 100 in the event that a dry fire condition does exist.

After a second amount of time has passed, as indicated by step 740, a temperature (T2) from the sensor 40 is recorded, step 750. If a calculated difference temperature, $\Delta T = T2 - T1$, exceeds a specified threshold value, step 760, then a dry fire condition exists. On the other hand, if $\Delta T$ is less than the threshold value, the heating element 25 is likely submerged in water and a dry fire condition is not detected.

It may be desirable, because of model and manufacturer's variations in water heater parameters, to repeat the detection methodology 700 one or more times. In this regard, such model and manufacturer's variations may affect the temperature characteristics of the heating element 25 such that a single dry fire test may fail to detect a dry fire condition depending on when the test is taken after activation of the heating element 25. Experiments have shown that, for many conventional water heating systems, the methodology 700 shown by FIG. 4 with a temperature sensor 40 coupled directly to the heating element 40 can detect a dry fire condition within less than approximately one minute of activating the heating element 25 with many successful detections occuring in just a few seconds after activation of the heating element 25. However, using a similar methodology based on measurements of a temperature sensor 40 mounted on the exterior wall of the tank 17 can take up to approximately 10 minutes for at least some water heating systems. Moreover, coupling the temperature sensor 40 directly to the heating element 25, as described herein, can result in a dramatic reduction in the amount of time required to detect a dry fire condication after activation of the heating element 25.

It should be emphasized that the above-described embodiments of the present invention are merely possible examples of implementations and set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

Now, therefore, the following is claimed:

1. A water heating system, comprising:
a tank;
a heating element mounted on the tank;
a temperature sensor mounted on the heating element; and
a controller coupled to the temperature sensor, the controller configured to detect a dry fire condition associated with the heating element based on the temperature sensor,
wherein the temperature sensor is attached to a pivot arm that presses the sensor against the heating element.

2. The system of claim 1, wherein the controller is configured to determine first and second temperatures of the heating element at different times based on the temperature sensor, and wherein the controller is configured to perform a comparison of the first and second temperatures and to detect the dry fire condition based on the comparison.

3. The system of claim 1, wherein the controller automatically disables the heating element in response to the detected dry fire condition.

4. The system of claim 1, wherein the temperature sensor is a themistor.

5. The system of claim 1, further comprising a power supply relay coupled to the heating element, wherein the controller is configured to automatically place the power supply relay in an open position in response to the detected dry fire condition thereby preventing the relay from providing power to the heating element.

6. The system of claim 5, wherein the relay is a solid state relay.

7. The system of claim 1, wherein the controller is configured to detect the dry fire condition when a temperature difference of the heating element over a selected time interval exceeds a threshold value.

8. A water heating system, comprising:
a tank;
a heating element mounted on the tank, the heating element having an end that is exposed when the heating element is mounted to the tank;
a temperature sensor mounted on and contacting an outer surface of the exposed end of the heating element; and
a controller coupled to the temperature sensor, the controller configured to detect a dry fire condition associated with the heating element based on the temperature sensor.

9. A water heating system, comprising:
a tank;
a heating element mounted on the tank;
a temperature sensor mounted on the heating element; and
a controller coupled to the temperature sensor, the controller configured to disable the heating element based on the temperature sensor,
wherein the temperature sensor is attached to a pivot arm that presses the sensor against the heating element.

10. The system of claim 9, wherein the controller is configured to determine first and second temperatures of the heating element at different times based on the temperature sensor, and wherein the controller is configured to perform a comparison of the first and second temperatures and to disable the heating element based on the comparison.

11. A water heating system, comprising:
a tank;
a heating element mounted on the tank, the heating element having an end that is exposed when the heating element is mounted to the tank;
a temperature sensor mounted on and contacting an outer surface of the exposed end of the heating element; and
a controller coupled to the temperature sensor, the controller configured to disable the heating element based on the temperature sensor.

12. The system of claim 11, wherein the exposed end of the heating element has a plate, and wherein the temperature sensor is mounted on the plate.

13. A method for detecting a dry fire condition in a water heating system having a heating element mounted on a water tank, the method comprising the steps of:

sensing temperatures of the heating element at different times based on a temperature sensor coupled to the heating element;

detecting a dry fire condition based on at least one of the temperatures; and pressing the temperature sensor against a surface of the heating element during the sensing step.

14. The method of claim 13, further comprising the step of automatically disabling the heating element in response to the detecting.

15. The method of claim 13, wherein the detecting step comprises the steps of:

determining a rate of temperature change of the heating element; and comparing the rate of temperature change to a threshold.

16. The method of claim 13, wherein the heating element has an end that is exposed when the heating element is mounted on the tank, and wherein the temperature sensor is mounted on the exposed end of the heating element.

17. The method of claim 13, wherein the pressing step comprises the step of pressing, via a pivot arm, the temperature sensor against the surface of the heating element.

18. The method of claim 17, wherein the pivot arm is spring loaded.

19. The system of claim 9, wherein the pivot arm is spring loaded.

20. The system of claim 8, wherein the temperature sensor is pressed against the outer surface of the exposed end of the heating element.

21. The system of claim 11, wherein the temperature sensor is pressed against the outer surface of the exposed end of the heating element.

* * * * *